US007877886B1

(12) United States Patent
Hamilton

(10) Patent No.: US 7,877,886 B1
(45) Date of Patent: Feb. 1, 2011

(54) RETICLE FOR STADIAMETRIC RANGEFINDING

(75) Inventor: Samuel J. Hamilton, Mount Horeb, WI (US)

(73) Assignee: Sheltered Wings, Inc., Middleton, WI (US)

( * ) Notice: Subject to any disclaimer, the term of this patent is extended or adjusted under 35 U.S.C. 154(b) by 0 days.

(21) Appl. No.: 12/653,364

(22) Filed: Dec. 11, 2009

(51) Int. Cl.
*F41G 1/00* (2006.01)

(52) U.S. Cl. ..... 33/297

(58) Field of Classification Search ..... 33/297, 33/298

See application file for complete search history.

(56) References Cited

U.S. PATENT DOCUMENTS 4,205,916 A * 6/1980 Vogl et al. ..... 33/297
4,263,719 A * 4/1981 Murdoch ..... 33/297
4,285,137 A * 8/1981 Jennie ..... 33/298
4,403,421 A 9/1983 Shepherd
4,584,776 A 4/1986 Shepherd
4,730,920 A * 3/1988 Schlemmer et al. ..... 33/294
7,100,319 B2 * 9/2006 Paige ..... 33/298
2008/0202011 A1 * 8/2008 Shepherd ..... 42/130
2010/0110378 A1 * 5/2010 Cheng et al. ..... 351/208

* cited by examiner

*Primary Examiner*—G. Bradley Bennett
(74) *Attorney, Agent, or Firm*—Bennet K. Langlotz; Langlotz Patent & Trademark Works, Inc.

(57) ABSTRACT

A reticle for stadiametric rangefinding has a horizontal crosshair and a vertical crosshair that are attached to an optical element. The optical element defines an optical axis and a field of view. The crosshairs intersect perpendicularly at a location that is offset from the optical axis. There may be a plurality of rangefinding indicia shaped to indicate the size of an object at a specific range. The rangefinding indicia may be arranged in a position other than vertical.

17 Claims, 2 Drawing Sheets

RETICLE FOR STADIAMETRIC RANGEFINDING

FIELD OF THE INVENTION

The present invention relates to stadiametric rangefinding, and more particularly to shapes superimposed on an image that enable measurement of distances with a telescopic instrument.

BACKGROUND OF THE INVENTION

It is often desirable to measure the distance from the observer to a target for the purposes of surveying, determining focus in photography, or accurately aiming a weapon. Stadiametric rangefinding, or the stadia method, is a technique for measuring distances with a telescopic instrument. The stadia method is based upon the principle that in similar triangles homologous sides are proportional. This means that for a right triangle with a given angle, the ratio of adjacent side length to opposite side length is constant. By using a reticle with marks of a known angular spacing, the principle of similar triangles can be used to find either the distance to objects of known size or the size of objects at a known distance. In either case, the known parameter is used, in conjunction with the angular measurement, to derive the length of the other side.

Since a radian is defined as the angle formed when the length of a circular arc equals the radius of the circle, a milliradian (sometimes called a mil), is the angle formed when the length of a circular arc equals 1/1000 of the radius of the circle. An object 5 meters high, for example, will cover 1 mrad at 5000 meters, or 5 mrad at 1000 meters, or 25 mrad at 200 meters. Since the radian expresses a ratio, it is independent of the units used; an object 6 feet high covering 1 mrad will be 6000 feet distant.

A reticle is a shape superimposed on an image that is used for precise alignment of a device, most notably that of a telescopic sight. The minimum reticle consists of simple crossed lines, or crosshairs, that meet at the optical center of the device. Most commonly associated with telescopic sights for aiming firearms, crosshairs are also common in optical instruments used for astronomy and surveying.

Telescopic sights for firearms, most commonly referred to as scopes, are the devices most often associated with crosshairs. A number of patents have been granted for rangefinding reticles for scopes. Various reticle approaches also exist in the practiced prior art.

While the traditional thin crossing lines are the original and still the most familiar crosshair shape, they are really best suited for precision aiming at high contrast targets because the thin lines are easily lost in complex backgrounds, such as those encountered while hunting. Thicker bars are much easier to discern against a complex background, but lack the precision of thin lines. The most popular types of crosshairs in modern scopes are variants on duplex crosshairs, with bars that are thick on the perimeter and thin out in the middle. The thick bars allow the eye to quickly locate the center of the reticle, and the thin lines in the center allow for precision aiming. The thin lines in a duplex reticle may also be designed to be used as a measure. Called a 30/30 reticle, the thin lines on such a reticle span 30 inches at 100 yards when the scope's power is at 4×. This enables an experienced shooter to deduce (as opposed to guess or estimate) the range within an acceptable error limit.

It is desirable for the aiming point of riflescopes to be at the center of the circular field of view, because this provides a psychological confirmation of the aiming point, as well as providing a rough aiming point in rushed circumstances when discerning the cross hair aiming point is not possible. Moreover, while vertical holdovers tolerate some deviation from the center aiming point, lateral displacements of the aiming point would create a needless conflict with the user's natural expectation that the center of the circle will coincide with the center of aim.

Two examples of scopes utilizing a rangefinding reticle are found in U.S. Pat. Nos. 4,403,421 (Shepherd) and 4,584,776 (Shepherd). These patents disclose a telescopic sight including primary and secondary reticles separately disposed within separate image planes formed at respective opposite ends of an inverting tube. The secondary reticle bears engraved indicia for determining target range and for compensating for bullet drop.

The Shepherd patents feature engraved indicia of military figures for use in connection with military warfare. Each figure is visually associated with the respective bullet-drop compensation aiming point disposed vertically with respect to an engraved dot located centrally in the upper portion of the reticle image. Each of the figures is shaped to indicate the size of an object at a specific range. Furthermore, the figures represent specific distances. Even the head portion of the figures is sized to indicate the range of the object in the event that only the head of the object can be seen through the scope.

The Shepherd patents alternatively feature a reticle illustrated with engraved indicia for use by game hunter. These engraved indicia include a plurality of superimposed circles meeting in a single point on each of the circumferences of the circles. Each of the circles is visually associated with different range distances.

However, there are a number of problems with prior art patents and existing practiced prior art. These problems include obscuring of the object being ranged by the reticle if the reticle is centered. A centered reticle requires the user to place an object that he or she desires to be unobstructed outside the center of the device's field of view. However, in peripheral portions of the field of view, optical performance is degraded.

One of the major problems is that existing rangefinding reticles are employed in scopes attached to firearms. However, using telescopic sights attached to firearms to determine the range of unidentified objects is generally considered to be unsafe; a firearm should never be pointed at an object the shooter does not intend to shoot. Although binoculars and spotting scopes/monoculars (portable telescopes optimized for the observation of terrestrial objects) can be used to identify distant objects safely, they often omit reticles because they are not typically used to aim a firearm. An example of such a spotting scope/monocular is U.S. Design Patent D603,436 (Hamilton), hereby incorporated by reference in its entirety.

All of the above reticles and rangefinding scopes have significant disadvantages in terms of safety and visual clarity, at least for certain applications and needs.

It is therefore an object of this invention to provide a reticle for stadiametric rangefinding that enables spotting scopes and binoculars to measure the distance to an observed object without obscuring the object when it is centrally located in the field of view.

SUMMARY OF THE INVENTION

The present invention provides an improved reticle for stadiametric rangefinding, and overcomes the above-mentioned disadvantages and drawbacks of the prior art. As such, the general purpose of the present invention, which will be described subsequently in greater detail, is to provide an improved reticle for stadiametric rangefinding that has all the advantages of the prior art mentioned above.

To attain this, the preferred embodiment of the present invention essentially comprises a reticle for stadiametric rangefinding having a horizontal crosshair and a vertical crosshair that are attached to an optical element. The optical element defines an optical axis and a field of view. The crosshairs intersect perpendicularly at a location that is offset from the optical axis. The reticle may have a plurality of rangefinding indicia shaped to indicate the size of an object at a specific range. The rangefinding indicia may be arranged in a position other than vertical. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
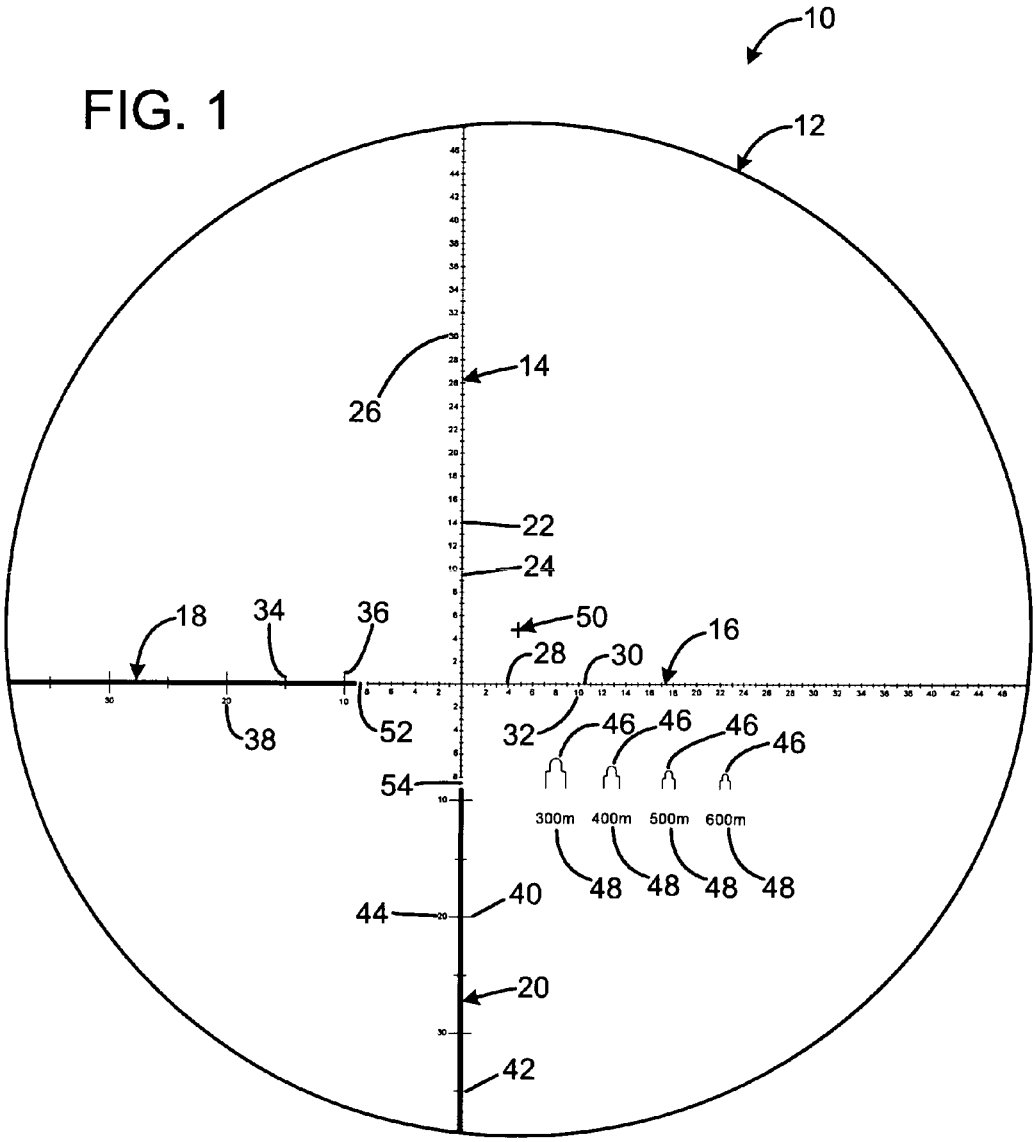
FIG. 1 is a front view of a first embodiment of the reticle for stadiametric rangefinding constructed in accordance with the principles of the present invention for use with a device having a 10× magnifying optical system.

A current embodiment of the reticle for stadiametric rangefinding of the present invention is shown and generally designated by the reference numeral 10.

FIG. 1 illustrates the improved reticle for stadiametric rangefinding 10 of the present invention for use with a 10× magnifying optical device. More particularly, the reticle 10 has an optical element 12 that defines an optical axis 50 and a field of view corresponding to the area bounded by the optical element. The field of view is circular in the current embodiment because the reticle is intended for use with an axially symmetric optical system that includes a circular lens. The reticle includes a horizontal crosshair 16 and a vertical crosshair 14. The crosshairs intersect perpendicularly at a location that is offset from the optical axis 50. The location of intersection serves as a primary measuring reference point. In the current embodiment, the intersection of the crosshairs is offset to the left of the optical axis by 5 milliradians and downwards by 5 milliradians. However, the crosshairs could be positioned to intersect at any desirable location in the field of view that prevents the crosshairs from obstructing an object that is centered in the field of view. At a minimum, it is preferable to separate each crosshair from the optical axis by a distance corresponding to at least 5% of the field of view's diameter, and preferably less than 10% to provide that the crosshair intersection is within an adequately high optical quality zone, and preferably more than 5% to ensure that typical targets will be adequately visible without being obscured by the crosshairs. At a minimum, it is preferable for the portion of the field of view that contains the optical axis and is bounded on the left by the vertical crosshair and on the bottom by the horizontal crosshair to have a surface area that is at least one-third of the entire field of view's surface area.

The reticle also includes a horizontal bar 18 and a vertical bar 20. In the current embodiment, the bars are thicker than the crosshairs. The bars direct the user's eye towards the intersection of the crosshairs and the optical axis. The bars are aligned with their corresponding crosshair. The bars extend from the outer edge of the field of view to a location that leaves a gap (52 and 54) corresponding to 1 mrad between the termination of the bar and the start of its corresponding crosshair. The crosshairs begin on the other side of the gap from their corresponding bar and terminate at the outer edge of the field of view.

The horizontal crosshair has major stadia marks 28, minor stadia marks 30, and angular measurement indicia 32 evenly spaced along it. Similarly, the vertical crosshair has major stadia marks 22, minor stadia marks 24, and angular measurement indicia 26 evenly spaced along it. On the crosshairs, the major stadia marks measure whole quantities of milliradians, the minor stadia marks measure half quantities of milliradians, and the angular measurement indicia show the numerical value of the major stadia marks having even values. The minor stadia marks are approximately half of the length of the major stadia marks.

The horizontal bar has major stadia marks 36, minor stadia marks 34, and angular measurement indicia 38 evenly spaced along it. Similarly, the vertical bar has major stadia marks 40, minor stadia marks 42, and angular measurement indicia 44 evenly spaced along it. On the bars, the major stadia marks measure quantities of milliradians that are multiples of ten, the minor stadia marks measure quantities of milliradians that are multiples of five, and the angular measurement indicia show the numerical value of the major stadia marks. The minor stadia marks are approximately half of the length of the major stadia marks.

The reticle also includes rangefinding indicia 46. Each rangefinding indicium has a corresponding range indicium 48. Each rangefinding indicium is shaped to indicate the size of an object at a specific range. The range indicia show the value of the range of their corresponding rangefinding indicia. In the current embodiment, the rangefinding indicia are man-shaped silhouettes and correspond to 300 m, 400 m, 500 m, and 600 m. In the current embodiment, the rangefinding indicia are positioned side-by-side in a horizontal arrangement across the field of view to the right of the vertical crosshair and below the horizontal crosshair. The bottoms of the rangefinding indicia are vertically aligned parallel to the horizontal crosshair, and below the horizontal line to avoid their obscuring objects in the largest, primary upper right viewing quadrant. The indicia are also not positioned in the smallest quadrant to avoid space constraints, and to facilitate the user transiting from viewing an object in the upper quadrant, and shifting readily to align the viewed object with the appropriate indicia. However, the rangefinding indicia could be positioned at any desirable location in the field of view that prevents the rangefinding indicia from obstructing an object that is centered in the field of view. The rangefinding indicia are not limited to being arranged vertically because they are generally not used to determine bullet-drop in this application.

In the current embodiment, the optical element is composed of two parallel discs of clear glass with plane surfaces. The crosshairs, bars, rangefinding indicia, and range indicia are etched on an internal surface of one of the discs, resulting in the etchings being laminated between the two glass discs.

Figure 2:
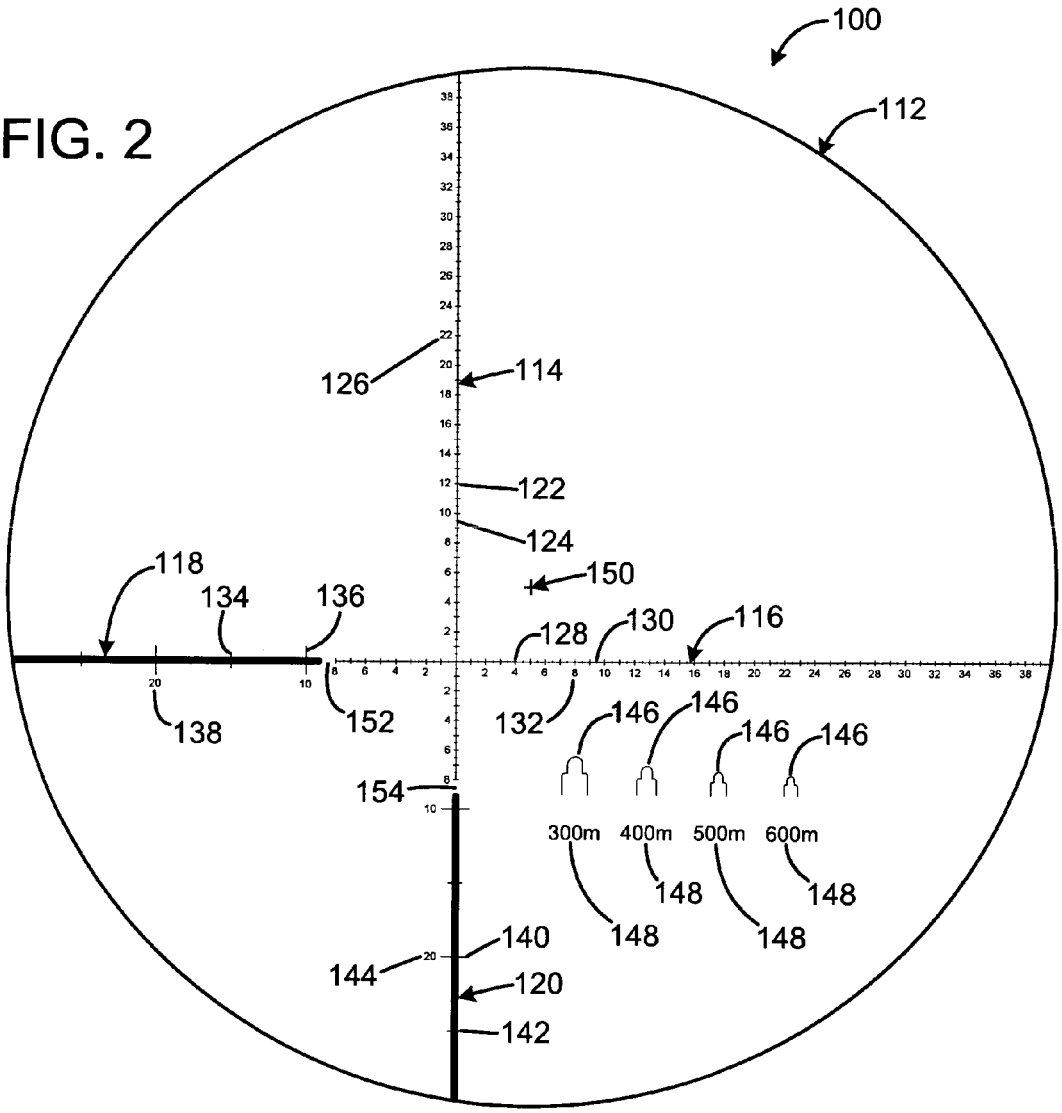
FIG. 2 is a front view of a second embodiment of the reticle for stadiametric rangefinding constructed in accordance with the principles of the present invention for use with a device having a 15× magnifying optical system.

FIG. 2 illustrates the improved reticle for stadiametric rangefinding 100 of the present invention for use with a 15× magnifying optical device. More particularly, the reticle 100 has an optical element 112 that defines an optical axis 150 and a field of view bounded by the optical element. The field of view is circular in the current embodiment because the reticle is intended for use with an axially symmetric optical system that includes a circular lens. The reticle includes a horizontal crosshair 116 and a vertical crosshair 114. The crosshairs intersect perpendicularly at a location that is offset from the optical axis. In the current embodiment, the intersection of the crosshairs is offset to the left of the optical axis by 5 milliradians and downwards by 5 milliradians millimeters. However, the crosshairs could be positioned to intersect at any desirable location in the field of view that prevents the crosshairs from obstructing an object that is centered in the field of view. At a minimum, it is preferable to separate each crosshair from the optical axis by a distance corresponding to at least 5% of the field of view's diameter, and preferably less than 10% to provide that the crosshair intersection is within an adequately high optical quality zone, and preferably more than 5% to ensure that typical targets will be adequately visible without being obscured by the crosshairs. At a minimum, it is preferable for the portion of the field of view that contains the optical axis and is bounded on the left by the vertical crosshair and on the bottom by the horizontal crosshair to have a surface area that is at least one-third of the entire field of view's surface area.

The reticle also includes a horizontal bar 118 and a vertical bar 120. In the current embodiment, the bars are thicker than the crosshairs. The bars direct the user's eye towards the intersection of the crosshairs and the optical axis. The bars are aligned with their corresponding crosshair. The bars extend from the outer edge of the field of view to a location that leaves a gap (152 and 154) corresponding to 1 mrad between the termination of the bar and the start of its corresponding crosshair. The crosshairs begin on the other side of the gap from their corresponding bar and terminate at the outer edge of the field of view.

The horizontal crosshair has major stadia marks 128, minor stadia marks 130, and angular measurement indicia 132 evenly spaced along it. Similarly, the vertical crosshair has major stadia marks 122, minor stadia marks 124, and angular measurement indicia 126 evenly spaced along it. On the crosshairs, the major stadia marks measure whole quantities of milliradians, the minor stadia marks measure half quantities of milliradians, and the angular measurement indicia show the numerical value of the major stadia marks having even values. The minor stadia marks are approximately half of the length of the major stadia marks.

The horizontal bar has major stadia marks 136, minor stadia marks 134, and angular measurement indicia 138 evenly spaced along it. Similarly, the vertical bar has major stadia marks 140, minor stadia marks 142, and angular measurement indicia 144 evenly spaced along it. On the bars, the major stadia marks measure quantities of milliradians that are multiples of ten, the minor stadia marks measure quantities of milliradians that are multiples of five, and the angular measurement indicia show the numerical value of the major stadia marks. The minor stadia marks are approximately half of the length of the major stadia marks.

Because the reticle 100 is intended for use with a higher magnification optical device than is the reticle 10, there are some differences between them. This results from the higher magnification device yielding a smaller field of view. Specifically, the stadia marks and angular measurement indicia of the reticle and hundred and are spaced further apart, and there are fewer of them. The crosshairs, bars, and stadia marks of the reticle 100 also have slight alterations to their line thicknesses; the thickness would be wider with lower magnification and narrower with higher magnification to compensate for the difference in magnification.

The reticle also includes rangefinding indicia 146. Each rangefinding indicium has a corresponding range indicium 148. Each rangefinding indicium is shaped to indicate the size of an object at a specific range. The range indicia show the value of the range of their corresponding rangefinding indicia. In the current embodiment, the rangefinding indicia are man-shaped silhouettes and correspond to 300 m, 400 m, 500 m, and 600 m. In the current embodiment, the rangefinding indicia are positioned side-by-side in a horizontal arrangement across the field of view to the right of the vertical crosshair and below the horizontal crosshair. The bottoms of the rangefinding indicia are vertically aligned parallel to the horizontal crosshair. However, the rangefinding indicia could be positioned at any desirable location in the field of view that prevents the rangefinding indicia from obstructing an object that is centered in the field of view. The rangefinding indicia are not limited to being arranged vertically because they are generally not used to determine bullet drop in this application.

In the current embodiment, the optical element is composed of two parallel discs of clear glass with plane surfaces. The crosshairs, bars, rangefinding indicia, and range indicia are etched on an internal surface of one of the discs, resulting in the etchings being laminated between the two glass discs.

In use, the reticle is installed in a spotting scope/monocular or in one side of a pair of binoculars. To determine the range of an object of known size to the viewer or the size of an object at a known range to the viewer, the user looks through the reticle and measures the object's angular width and/or angular height by aligning the object with the crosshairs and noting the appropriate angular measurement indicium for use in the stadia method calculation. If the object has a silhouette that is the same type as the rangefinding indicia, then the rangefinding indicia can be used to estimate the range of the object. This is accomplished by matching the object's silhouette to the closest corresponding rangefinding indicium and then reading the corresponding range indicium. Interpolation can be used to estimate the range of an object whose silhouette has a size that is between the sizes of two rangefinding indicia.

Offsetting the intersection of the crosshairs and the rangefinding indicia from the optical axis prevents the reticle from obstructing an object viewed through it. This enables an object to be positioned in the center of the field of view, which is the optimal location because optical performance is best in the center of axially symmetric optical systems. In this location, the object is naturally bracketed by the crosshairs, so the user does not have to move the object into an unnatural portion of the field of view in order to determine its range. Furthermore, for scanning and non-ranging type viewing, a reticle can potentially distract the viewer. By offsetting the reticle, it prevents the user from becoming distracted, making this type of viewing easier.

The reticle for stadiametric rangefinding thus described enables spotting scopes and binoculars to measure the distance to an observed object without obscuring the object when the object is centrally located in the field of view.

While a current embodiment of reticle for stadiametric rangefinding has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rangefinding reticle for an optical device having optical element that defines an optical axis and a field of view, the reticle comprising:

a horizontal crosshair attached to the optical element;

a vertical crosshair attached to the optical element;

the crosshairs intersect perpendicularly at a location; and the location being offset from the optical axis.

2. The reticle of claim 1 wherein each of the crosshairs is offset from the optical axis by a distance equal to at least 5% of the field of view's diameter.

3. The reticle of claim 1 wherein a portion of the field of view that contains the optical axis and is bounded by the crosshairs has a surface area equal to at least one-third of the field of view's surface area.

4. The reticle of claim 1 further comprising a plurality of rangefinding indicia shaped to indicate the size of an object at a specific range, the rangefinding indicia being arranged in a position other than vertical.

5. The reticle of claim 4 wherein the rangefinding indicia are positioned side-by-side in a horizontal arrangement.

6. The reticle of claim 5 wherein the rangefinding indicia have bottoms that are vertically aligned parallel to the horizontal crosshair.

7. The reticle of claim 4 wherein the rangefinding indicia are separated from the optical axis by the horizontal crosshair.

8. The reticle of claim 1 wherein the crosshairs each comprise a thinner line portion and a thicker bar portion, the bar portions being separated from the line portions by a gap.

9. The reticle of claim 8 wherein the line portions of the crosshairs each comprise major stadia marks, a distance between adjacent major stadia marks defining a unit of angular measurement.

10. The reticle of claim 9 wherein the gaps separate the bar portions from their corresponding line portions by a distance corresponding to one unit of angular measurement.

11. The reticle of claim 1 wherein the location is offset from center of a circular field of view.

12. A rangefinding reticle for an optical device having an optical element that defines an optical axis and a field of view, the reticle comprising:

a primary measuring reference point attached to the optical element; and the reference point being offset from the optical axis.

13. The reticle of claim 12 wherein the reference point is defined by a location where a horizontal crosshair attached to the optical element and a vertical crosshair attached to the optical element intersect perpendicularly.

14. The reticle of claim 13 wherein the crosshairs each comprise major stadia marks, a distance between adjacent media stadia marks defining a unit of angular measurement.

15. The reticle of claim 12 wherein the reference point is offset from center of a circular field of view.

16. The reticle of claim 14 wherein each of the crosshairs is offset from the optical axis by a distance equal to at least 5% of the field of view's diameter.

17. The reticle of claim 14, wherein each of the crosshairs is offset from the optical axis by a distance equal to no more than 10% of the field of view's diameter.

* * * * *